United States Patent [19]

Loevinger

[11] Patent Number: 4,624,189

[45] Date of Patent: Nov. 25, 1986

[54] HEATED OUTLET VALVE FOR RAILWAY TANK CAR

[76] Inventor: Richard P. Loevinger, P.O. Box 68, Brandon, S. Dak. 57005

[21] Appl. No.: 583,648

[22] Filed: Feb. 27, 1984

[51] Int. Cl.[4] ..... B61D 27/00; B61D 5/00; F16K 49/00

[52] U.S. Cl. ..... 105/451; 137/340; 137/347; 137/590; 165/41; 165/132; 222/146.2

[58] Field of Search ..... 105/358, 360, 451; 137/340, 347, 350, 590; 165/41, 132, 169; 222/146.2, 146.4

[56] References Cited

U.S. PATENT DOCUMENTS

| | | | |
|---|---|---|---|
| 1,569,605 | 1/1926 | Ash | 105/451 X |
| 3,176,764 | 4/1965 | Barbera | 105/451 X |
| 3,228,466 | 1/1966 | Carleton | 105/451 X |
| 3,439,910 | 4/1969 | Regelin et al. | 137/340 X |
| 3,687,087 | 8/1972 | Yurkoski et al. | 105/358 X |
| 3,831,622 | 8/1974 | Grewer et al. | 137/340 |
| 3,973,585 | 8/1976 | Henderson | 137/340 |
| 4,121,611 | 10/1978 | Bayerl | 137/340 |
| 4,476,788 | 10/1984 | Loevinger | 105/451 |

FOREIGN PATENT DOCUMENTS

| | | | |
|---|---|---|---|
| 903530 | 8/1962 | United Kingdom | 137/340 |

*Primary Examiner*—Robert B. Reeves
*Assistant Examiner*—David F. Hubbuch
*Attorney, Agent, or Firm*—Richard J. Myers & Assoc.

[57] ABSTRACT

A valve attachment flange comprising the lading outlet for a railway tank car is placed in an insulative space between a heat element, heated fluid medium carrying heat ducts and the bottom of the car. The outlet is surrounded by a heat chamber in fluid flow communication with the heat ducts of the heat elements whereby the heat chamber surrounding the outlet is efficiently heated simultaneous with the heating of the lading by the heat element to promote flow of lading from the tank. This arrangement promotes fast efficient heating of the lading on top of and adjacent the valve and enables a valve attached to the recessed attachment flange to extend downwardly from the bottom of the car a lesser amount than conventionally mounted valves.

3 Claims, 5 Drawing Figures

HEATED OUTLET VALVE FOR RAILWAY TANK CAR

BACKGROUND OF THE INVENTION

This application is related to U.S. Pat. No. 4,476,788 and the teachings of that application are herein incorporated by this reference.

1. Field of the Invention

This invention relates to an improved fluid medium heated outlet valve centrally located at the bottom of a railway tank car.

2. Description of the Prior Art

Heated outlet valves for facilitating the emptying or removal of the cargo or lading from railway tank cars are old and well-known. Such valves, which may be of either the plug or the ball or the wafer type are typically bolted, or otherwise sealingly engaged flush with the inner lower surface of the bottom of the tank of the car. Typically a steam jacket surrounds the valve at the exterior of the car below the exterior surface of the tank. Consequently such valves depend, or the steam jackets of such valves depend or suspend, a substantial distance beneath the lower exterior surface of the car and are subject to damage from mechanical engagement of objects passing beneath the car. Also, the exterior of the steam jacket is surrounded by air and inefficiently radiates heat into that surrounding air rather than using that heat to raise the temperature and consequently lower the viscosity of the lading immediately above and adjacent the valve.

SUMMARY OF THE INVENTION

A heated outlet valve for the tank of the railway tank car has an annular attachment member which projects upwardly into the interior of the car to be sealingly engaged with an interior heat element and the bottom of the car. The valve is sealingly engaged with the lower side of the attachment member. An annular fluid passage for a heated medium, such as hot water, hot oil or steam, is provided around the valve and formed between a heating element interior of the car and the bottom of the car.

Location of the steam chamber for heating the valve within the interior of the tank makes the lading adjacent the valve and the valve itself more readily heatable to promote a more heat efficient flow of lading from the tank through the valve in a shorter period of time.

DETAILED DESCRIPTION OF THE INVENTION

Figure 1:
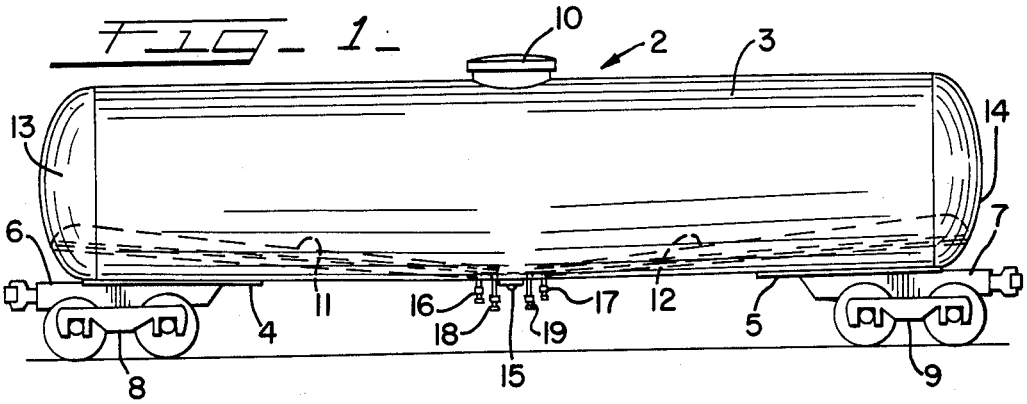
FIG. 1 is a side elevation view of a railway tank car having the valve of this invention.

FIG. 1 shows, in a side sectional elevation view, a railway tank car 2 having a tank 3, tank cradles 4 and 5, stub draft sills 6 and 7 and wheel trucks 8 and 9 which rollingly support the tank.

Tank 3 is provided with a loading bath or lading inlet port 10 which is generally located in the top central portion of the car as shown.

Located within the car is a pair of sloped heat elements 11 and 12 which slope downwardly from one of the ends 13 or 14 of the car toward the bottom center of the car at which is located outlet valve 15. Adjacent valve 15 are provided a pair of heated fluid medium inlet pipes 16 and 17 and a pair of fluid outlet pipes, such as 18 and 19. To heat the bottom of the tank, and the lading contained in it, a heated fluid medium, such as hot oil or steam or hot water, is forced into each of the inlets from a source (not shown). The input medium circulates through a plurality of heat exchange passageways, or flow ducts in each respective heat exchange element and eventually flows out of an outlet, such as outlet 18 for element 11 and outlet 19 for element 12. The medium may be dumped to ground or returned to the source, where it is reheated and circulated again.

As shown, elements 11 and 12 slope from the ends 13 and 14 toward valve 15. This slope assures lading will flow to the valve and it also assures that water or condensate within elements 11 and 12 will drain out or flow from the elements to eliminate freezing and to remove corrosive fluids in the elements and thereby aid in prolonging the working life of the heat elements.

Figure 2:
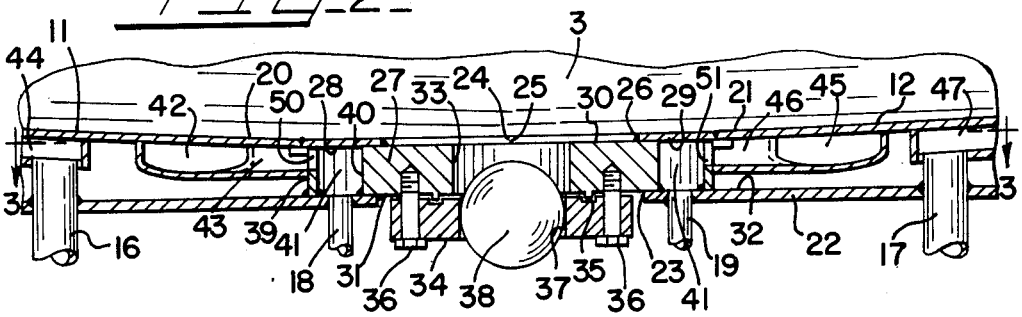
FIG. 2 is an enlarged sectional view of the valve shown engaged with the tank in FIG. 1.

As best shown in FIG. 2, heat elements 11 and 12 each have a top plate 20 and 21, respectively, which are placed above and substantially vertically spaced from the bottom portion or plate 22 of tank 3.

A circular opening or space defined by an annular surface 23 is provided in the bottom plate 22 of the tank. Similarly, plates 20 and 21 of units or elements 11 and 12 have central edges or terminal ends 24 and 25 which meet and are welded together in sealing engagement with each other. Central of this transverse weld seam or joint a circular opening defined by annular surface 26 is provided. The opening in the tank bottom and the opening in the heat elements are substantially aligned with each other with the element opening being vertically spaced from the bottom opening.

A valve attachment means, such as annular flange 27, is interposed between lower surfaces 28 and 29 of plates 20 and 21, respectively, and has an upper surface 30 sealingly engaged with the plates 20 and 21.

Flange 27 also has a lower surface 31 which is sealingly engaged with an upper surface 32 of tank bottom 22. Flange 27 is preferably sealingly engaged with the upper and lower plates by welding, as indicated in FIG. 2. Extending between upper surface 30 and lower surface 31 is a fluid flow opening 33.

Sealingly engaged with the lower surface 31 of flange 27 is a valve body 34 which is in sealing engagement with the flange by appropriate means such as annular seal 35 and a plurality of threaded fasteners 36. In valve body 34 is a fluid flow opening 37 which is in fluid flow communication with opening 33 in flange 27 to enable liquid lading to flow by gravity from the tank 3. A valve element, such as pivotal valve wafer or disc 38, which could also be a ball, is provided within opening 37 of valve body 34 to selectively seal and unseal the opening 37. Well known operator means for selectively closing and unclosing wafer 38 are not shown as they form no part of this invention.

Figure 3:
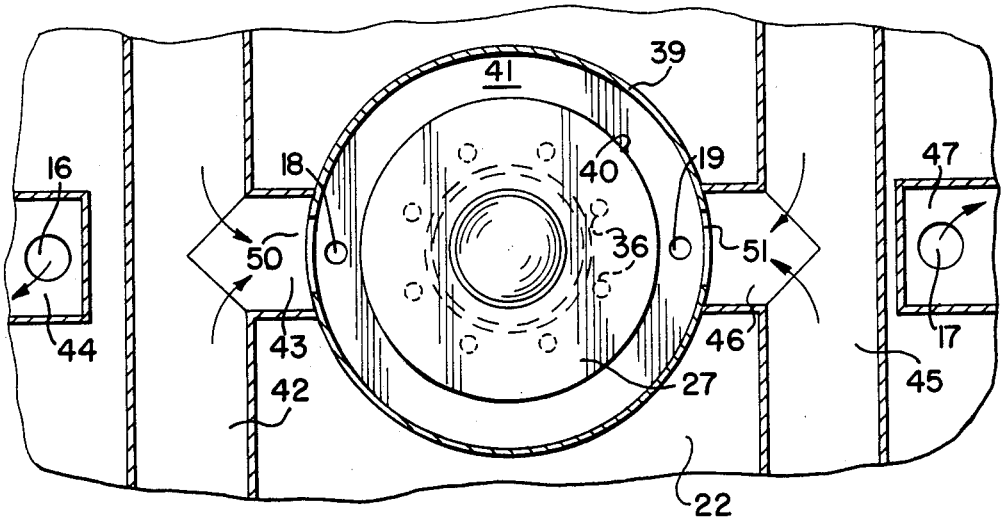
FIG. 3 is a top cutaway view of the valve arrangement shown in FIG. 2 as indicated by the section line 3—3.

As best shown in FIGS. 2 and 3, an annular plate member 39 is positioned concentric with and radially outwardly spaced from a radially outward facing surface 40 of flange 27 to form a substantially annular space 41 surrounding flange 27 and defined at the lower portion by surface 32 of bottom 22 and at the upper portion by surfaces 28 and 29 of plates 20 and 21, respectively.

Heated medium outlet conduits 18 and 19 are in fluid flow communication with annular space 41. Affixed to the lower surface 28 of plate 20 is a transversely extending fluid flow duct 42 having a connecting duct 43 placing duct 42 in fluid flow communication with annular space 41 surrounding valve attachment flange 27 by an opening 50 in annular plate 39. An inlet duct 44 is affixed to plate 20 and in fluid flow communication with inlet conduit 16.

Also, affixed to the lower surface 29 of plate 21 is a transversely extending fluid duct 45 which has a connecting duct 46 placing it in fluid flow communication with annular space 41 by an opening 51 in annular plate 39. An inlet duct 47 is affixed to plate 21 and is in fluid flow communication with inlet conduit 17.

Each inlet duct 44 and 47 is in fluid flow communication with outlet ducts 43 and 46, respectively, to enable steam or hot water or oil introduced into inlet conduits 16 and 17 to circulate through heat elements 11 and 12, empty into annular space 41 surrounding flange 27 and exit through outlet conduits 18 or 19 for spilling on the ground or into a receptacle or for being recirculated to the source for reheating and recirculation through the heat elements again.

Figure 5:
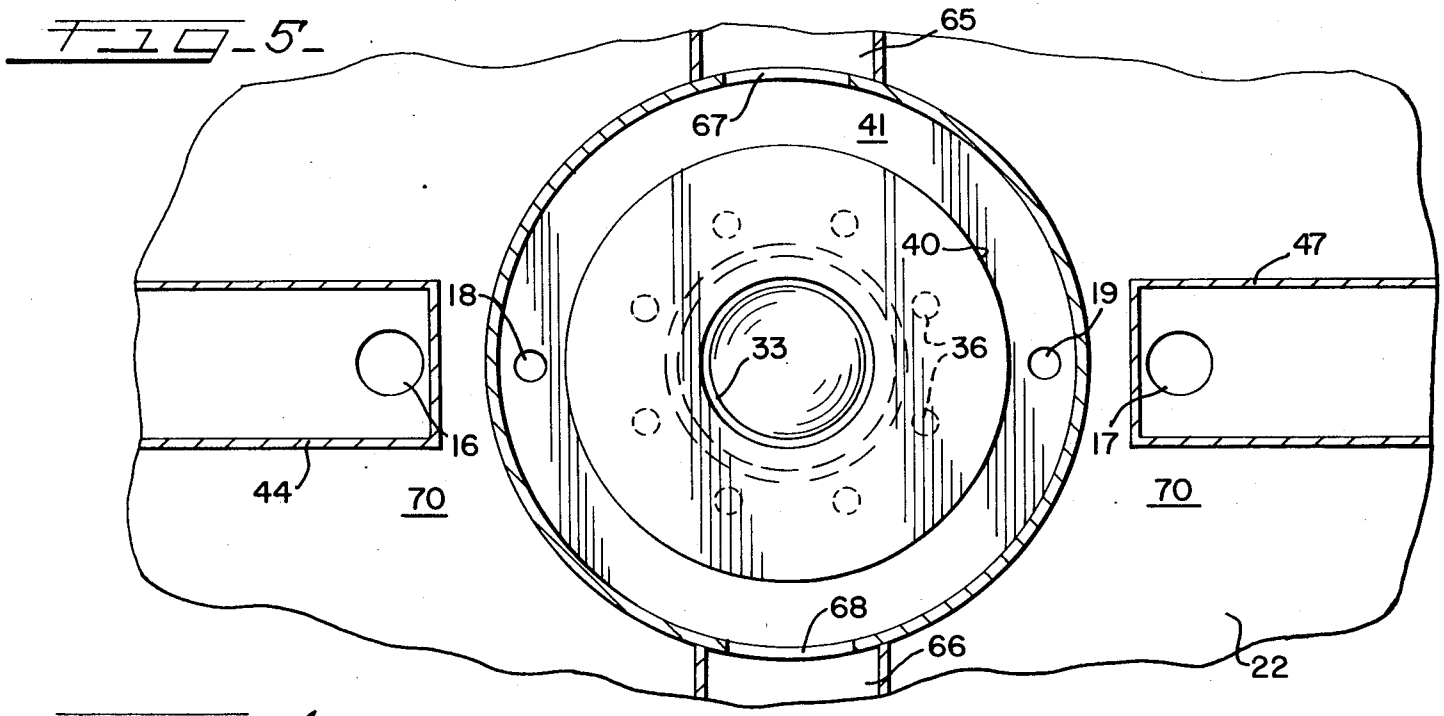
FIG. 5 is a sectional view of the valve shown in FIG. 4, as indicated by the section line 5—5.
Figure 4:
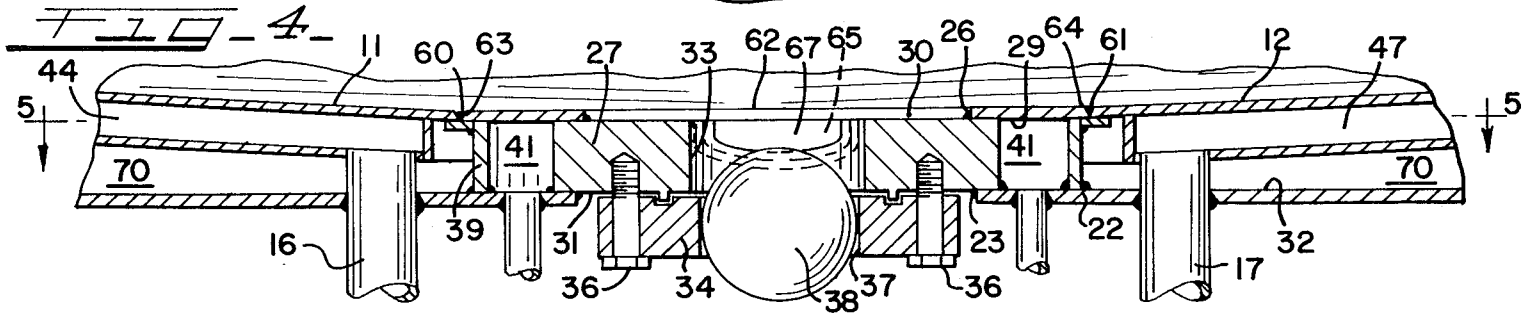
FIG. 4 is an enlarged cross-sectional view of an alternate embodiment of a heated valve arrangement of this invention.

FIGS. 4 and 5 show an alternate embodiment of the outlet valve and heating element and duct arrangement shown in FIGS. 2 and 3. With the exception that the transverse heat ducts 42 and 45 as shown in FIGS. 2 and 3 are omitted, the embodiments are substantially identical. Like elements in FIGS. 4 and 5 are identified with the same reference numerals as those used in FIGS. 2 and 3.

In FIGS. 4 and 5, the heat elements have terminal ends 60 for element 11 and 61 for element 12 which are longitudinally spaced from each other and a transverse plate 62 having an end 63 joined with end 60 and an end 64 joined with end 61 is used as the top cover for the valve.

Plate 62 has a first transverse duct 65 and a second transverse duct 66. Ducts 65 and 66 are placed in fluid flow communication with annular space 41 defined between flange 27 and annular plate 39.

Advantages of this valve structure are having the flange 27 within the tank reduces the distance the valve depends or extends downwardly from the bottom of the car. Presence of the valve flange within the car and sealingly engaged with the plates 20 and 21 of the heat elements 11 and 12 and surrounded by annular space or fluid medium heat chamber or duct enables a rapid heating of the valve flange and body and consequently provides for rapidly raising the temperature of lading immediately adjacent opening 33 to enable the fluid to commence flow through the flange and valve.

Also, due to the plates 20 and 21 being substantially flush with the top of flange 27 all lading will tend to drain from the tank by flowing down the sloped plates and through the valve opening.

As annular space 41 is within an insulative dead air space 70 between bottom 22 and plates 20 and 21 less heat is dissipated to the atmosphere and consequently more is forced to radiate through the flange and into the surrounding or adjacent lading.

By having the valve attachment flange mounted above the bottom of the car within the tank the valve attached to the flange depends or extends downward from the tank a lesser amount. This feature provides greater road clearance for the tank and makes the valve less susceptible to damage. The greater road clearance is possible because the flange which intrudes into the tank has its top surface engaged with the lading supporting plates of the heat elements. These plates are sloped toward the valve as shown to promote gravity flow of all cargo from the tank.

What is claimed is:

1. In a lading tank of a railway tank car, said tank car having a bottom and a pair of heat elements sloped toward an outlet valve opening of said tank car and vertically spaced above said bottom and sealed to said tank car for forming an insulated dead air space between said heat elements and said bottom, and heated fluid medium heat ducts associated with said heat elements for heating said heat elements, said heat ducts having a heated fluid medium inlet and outlet, said heat elements defining a fluid flow means communicating with said outlet valve opening, said fluid flow means comprising an annular plate member concentrically disposed to said outlet valve opening and sealingly located between the bottom of the tank and said heat elements, and an annular flange concentrically disposed to said outlet valve opening and sealingly located completely between the bottom of the tank and said heat elements, said annular flange and said annular plate defining therebetween an annular heat chamber completely surrounding said annular flange, means connecting said heat ducts to the interior of said annular heat chamber, said fluid flow means being disposed in said insulated dead air space, said annular flange having a fluid flow opening communicating with said outlet valve opening, whereby the flow of the heated fluid medium through the heat chamber heats the annular flange which in turn transfers heat to the lading flowing out of the tank car outlet valve opening.

2. The invention as defined in claim 1 in which said outlet for said heated fluid medium is located in said annular heat chamber.

3. The invention defined in claim 1 together with valve means sealingly engaged with said outlet valve opening for selectively sealing and unsealing said outlet valve opening.

* * * * *